US009059542B2

(12) United States Patent
Oh et al.

(10) Patent No.: US 9,059,542 B2
(45) Date of Patent: Jun. 16, 2015

(54) QUICK CONNECT POWER CONNECTOR

(71) Applicant: TYCO ELECTRONICS CORPORATION, Berwyn, PA (US)

(72) Inventors: Lawrence Se-Jun Oh, Hummelstown, PA (US); John Louis McKibben, Dallastown, PA (US); David James Fabian, Mount Joy, PA (US); Chong Hun Yi, Mechanicsburg, PA (US); Robert Mulfinger, York Haven, PA (US); Brent David Yohn, Newport, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 87 days.

(21) Appl. No.: 13/948,866

(22) Filed: Jul. 23, 2013

(65) Prior Publication Data

US 2015/0031228 A1 Jan. 29, 2015

(51) Int. Cl.

| | |
|---|---|
| ***H01R 4/50*** | (2006.01) |
| ***H01R 13/641*** | (2006.01) |
| ***H01R 13/627*** | (2006.01) |
| *H01R 4/48* | (2006.01) |

(52) U.S. Cl.

CPC ..... *H01R 13/641* (2013.01); *H01R 13/6275* (2013.01); *H01R 4/48* (2013.01)

(58) Field of Classification Search

CPC ..... H01R 4/48; H01R 13/639

USPC ..... 439/347, 489

See application file for complete search history.

(56) References Cited

U.S. PATENT DOCUMENTS

| | | | | | |
|---|---|---|---|---|---|
| 4,590,540 | A * | 5/1986 | Nicholson et al. | ..... | 439/347 |
| 5,013,258 | A * | 5/1991 | Schaef | ..... | 439/347 |
| 5,435,742 | A * | 7/1995 | Cecil, Jr. | ..... | 439/347 |
| 5,823,813 | A * | 10/1998 | Dye | ..... | 439/347 |
| 6,183,904 | B1 | 2/2001 | Kuboshima et al. | | |
| 6,302,720 | B1 * | 10/2001 | Muller | ..... | 439/347 |

FOREIGN PATENT DOCUMENTS

| | | |
|---|---|---|
| EP | 0 093 628 A2 | 11/1983 |
| EP | 1439610 A2 | 7/2004 |
| EP | 1737082 A2 | 12/2006 |

(Continued)

OTHER PUBLICATIONS

TE Connectivity Manual, "Quick Bar Reference Guide Bus Bar Connectivity", te.com/products/busbar, 6 pgs., Apr. 2013.

Tyco Electronics Power Connectors & Interconnection Systems, Cable Mounted Products, "RAPID LOCK Quick Connect/Disconnect Bus Bar Connectors", pp. 164-167, www.tycoelectronics.com, Feb. 2010.

(Continued)

*Primary Examiner* — Tho D Ta

(57) ABSTRACT

An electrical connector for connecting to a terminal post. A contact is provided in electrical engagement with the terminal post regardless of the orientation of the contact with respect to the terminal post. A locking slide is moveably mounted to the housing body. A first reference member is provided on a first end of the body of the connector, the first reference member is provided proximate a first sidewall of the body of the connector. A second reference member is provided on the first end of the body of the connector, the second reference member is provided proximate a second sidewall of the body of the connector. When the locking slide is in the prelocked position, the first reference member is visible and when the locking slide is in the locked position, the second reference member is visible.

20 Claims, 9 Drawing Sheets

(56) References Cited

FOREIGN PATENT DOCUMENTS

| | | | |
|---|---|---|---|
| FR | 2 941 819 | A1 | 8/2010 |
| WO | 2013 / 052571 | A1 | 4/2013 |

OTHER PUBLICATIONS

European Search Report, Mail Date. Nov. 24, 2014, EP 14 17 7784, Application No. 14177784.7-1801.

* cited by examiner

QUICK CONNECT POWER CONNECTOR

FIELD OF THE INVENTION

The present invention is directed to an electrical connector which provides a quick, simple and reliable connection to mating posts. In particular, the invention is directed to an electrical connector which prevents the improper mating of the connector to the post and provides a visual indication that the proper connection is secured.

BACKGROUND OF THE INVENTION

Electrical connectors for military, aviation, vehicular and other applications which required power must be able to withstand the environmental conditions, such as high vibrations, to which such connectors are subjected. The connectors also must provide high quality electrical connection through very broad ranges of temperature variations. Additionally, electrical connectors that are disposed in engine compartments and the like must protect against the inadvertent but inevitable manual contact that occurs as a mechanic tries to access a nearby component disposed in the crowded compartment. In many instances these electrical connectors must also accommodate extremely high amperage.

Such electrical connectors which are found in the prior art typically include a threaded stud terminal to which a threaded nut may be selectively connected. A typical prior art terminal for connection to such threaded stud terminal includes a mating end effectively defining a generally planar eyelet that is dimensioned to be slidably passed over the threaded stud terminal. The opposed end of such a terminal typically will be crimped and/or soldered to a conductor of the wire. The eyelet is maintained in a mated condition on the threaded stud terminal by the nut which is threaded tightly against the planar portion of the eyelet for securely retaining the terminal on the threaded stud terminal and for providing the high contact forces that are desired.

Such typical prior art electrical connector perform well under routine environmental conditions. However, the threaded components of these prior art connectors are fairly expensive to manufacture. Furthermore, the threaded interconnection adds significantly to assembly time and costs and can make disassembly for periodic repair and maintenance difficult, particularly as torque wrenches are required to properly seat the hardware. A number of parts are required to perfect the electrical connection, thereby also adding to the cost of the connection and creating the possibility of foreign object debris (FOD) which could damage engines and the like. Also, as the connectors are exposed to vibration and the like, the nuts may rotate off of the threaded component, which can lead to a failed, open electrical connection. In addition, any attempt to provide environmental sealing for such an electrical connection will generally require an entirely separate protection means that is functionally and structurally unrelated to the threaded interconnection to the alternator.

Many prior art electrical connectors rely upon resiliency of the metal to achieve electrical connection. However, it is extremely difficult to achieve the high contact forces with an electrical connector that must also ensure a large surface contact area and a large cross sectional area of metal to effect a reliable electrical connection. Other prior art electrical connectors have included spring means which are intended to achieve secure electrical connection without resorting to combinations of threads and nuts. Still other connectors have included a stamped member having a pair of deflectable arms with apertures extending therethrough. The arms can be biased such that the apertures align with one another to permit insertion of a pin through the aligned apertures. However, when the biasing force on the arms is released, the arms resiliently return to a condition where they bind against the pin inserted through the apertures. The prior art further includes the use of clips which perform no direct electrical connection function, but which securely retain the housings of two electrical connectors together.

In applications which do not use threaded components or the like, simple insertion of the connector onto terminal posts does not assure that the connectors are properly positioned and locked in place. In order to be sure that the components are properly connected and electrically engaged, a latch assembly/position assurance member is provided. Often, an audible click is typically used to detect if the connector is fully mated, however, background noise can make this ineffective.

However, even with these position assurance members, a number of connectors and terminals are not fully mated, causing system failures. This is due to the fact that some connectors and terminals are mated far enough to make initial, electrical contact but the latches of the position assurance members are not fully engaged causing the connector to not be locked or secured on the terminal. These connectors later come apart in the field, e.g. as a vehicle is driven on bumpy roads etc., causing loss of system function. Therefore, incorporating position assurance members into the connectors does not guarantee that the connectors will be properly mated and secured, as in many instances the operator does not properly activate the position assurance member.

It would be beneficial to have connectors which overcome the problems identified above and which allow for quick connection without the use of tools and which provide for a visual means to assure that the connectors are properly mated.

SUMMARY OF THE INVENTION

In view of the above, it is an object of the subject invention to provide a connector which provides a quick, simple and reliable connection to mating posts and to the power bus to which the posts are connected.

It is another object of the subject invention to provide a high amperage electrical connector that enables quick connection and disconnection.

It is another object of the subject invention to provide a connector with a locking slide which ensures that the connector is fully inserted onto the post, thereby ensuring that a positive electrical connection is provided and maintained.

It is another object of the subject invention to provide a connector with a position assurance member to ensure that a positive electrical connection is provided and maintained.

It is another object of the subject invention to provide a connector with a visual indication which provides a quick and cost effective means to confirm that the connection is secured.

It is another object of the subject invention to provide a one piece connector, thereby eliminating loose components which can fall during installation or which can come loose during operation.

It is another object of the subject invention to provide a connector which requires no tooling to install.

It is another object of the subject invention to provide a connector which can be inserted onto a post from any direction, thereby allowing the connector be terminated to the post regardless of orientation.

It is another object of the subject invention to provide a connector in which the electrical connection to the post will remain secure regardless of vibration or other environmental conditions.

An embodiment is directed to an electrical connector for connecting to a terminal post. The electrical connector comprising includes a housing body having a post receiving passage for receiving the terminal post therein. A contact is provided in the post receiving passage. The contact is provided in electrical engagement with the terminal post inserted into the post receiving passage regardless of the orientation of the contact with respect to the terminal post. A locking slide is moveably mounted to the housing body, the locking slide being moveable between a prelocked position and a locked position. The locking slide includes a locking latch having a locking surface which cooperates with a recess of the terminal post when the locking slide is in the locked position.

An embodiment is also directed to an electrical connector for connecting to a terminal post. The electrical connector includes a housing body with a post receiving passage for receiving the terminal post therein. The housing body has a stop surface provided thereon. A contact is provided in the post receiving passage. The contact is provided in electrical engagement with the terminal post inserted into the post receiving passage regardless of the orientation of the contact with respect to the terminal post. A locking slide is moveably mounted to the housing body, such that the locking slide is moveable between a prelocked position and a locked position. A locking latch is securely maintained in the locking slide. The locking latch cooperates with the stop surface to prevent the movement of the locking slide to the locked position if the electrical connector is not properly mated to the terminal post. The locking latch has a radiused locking surface which cooperates with a recess of the terminal post when the locking slide is in the locked position.

An embodiment is also directed to an electrical connector for connecting to a terminal post. The electrical connector includes a housing body having a post receiving passage for receiving the terminal post therein. A contact is provided in the post receiving passage. The contact is provided in electrical engagement with the terminal post inserted into the post receiving passage regardless of the orientation of the contact with respect to the terminal post. A locking slide is moveably mounted to the housing body. A first reference member is provided on a first end of the body of the connector, the first reference member is provided proximate a first sidewall of the body of the connector. A second reference member is provided on the first end of the body of the connector, the second reference member is provided proximate a second sidewall of the body of the connector. When the locking slide is in the prelocked position, the first reference member is visible and when the locking slide is in the locked position, the second reference member is visible.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
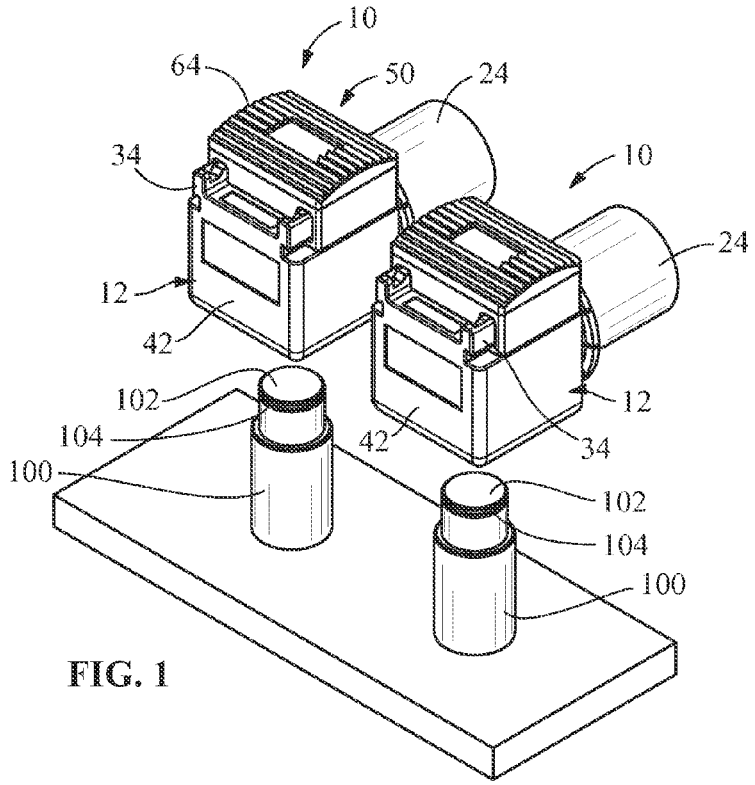
FIG. 1 is a perspective view of an illustrative embodiment of two quick connect power connectors according to the present invention prior to mounting to mating posts.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

Figure 2:
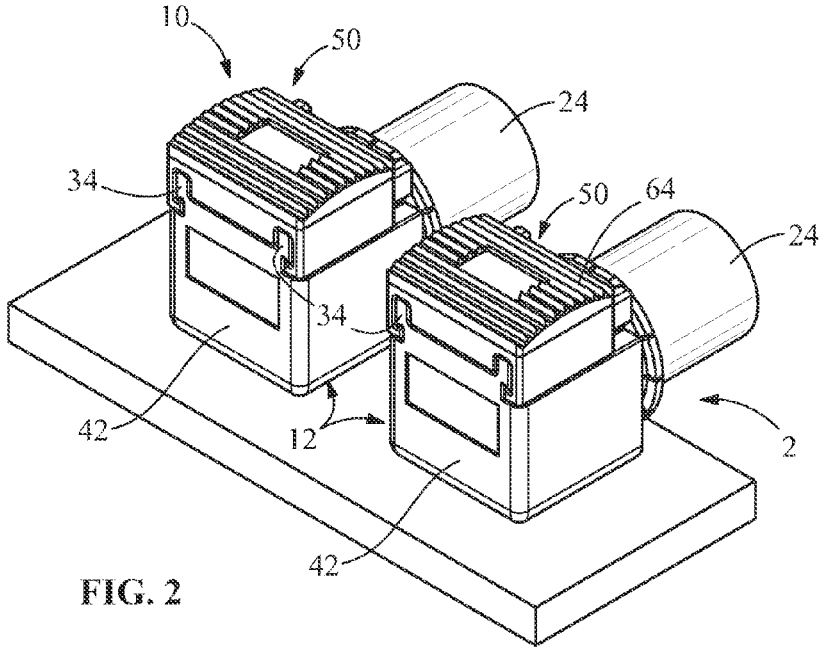
FIG. 2 is a perspective view of the two quick connect power connectors fully mated to the mating posts.

FIG. 1 shows a perspective view of two electrical connectors or plugs 10 prior to insertion on male posts or mating pins 100. FIG. 2 illustrates the connectors 10 fully mated to the posts 100. The electrical connectors 10 and posts 100 are shown as illustrative representations. The particular configuration of the connectors 10 and posts 100 may vary without departing from the scope of the invention. While two connectors 10 are shown, any number of connectors can be used without departing from the scope of the invention.

Referring to FIGS. 3 through 9, each electrical connector 10 has a housing body 12 with a post receiving passage 14 for receiving a respective post 100 therein. The electrical connector 10 has a first or top end 16 and an oppositely facing second or bottom end 18 which has an opening 20 to receive the post 100 therethrough. The opening 20 extends to the post receiving passage 14. A conductor or wire receiving sidewall 22 extends between the first end 16 and the post receiving end 18. A conductor or wire (not shown), is inserted into a conductive wire receiving member 24 which extends from the sidewall 22 and is terminated thereto by crimping or other known termination methods. An insulation receiving recess 26 extends circumferentially around the conductive wire receiving member 24. The insulation receiving recess 26 allows an insulator, such as, but not limited to, a boot, to be installed over the conductive wire receiving member 26, thereby insulating the conductive wire receiving member 24 from other components and the operator.

Figure 6:
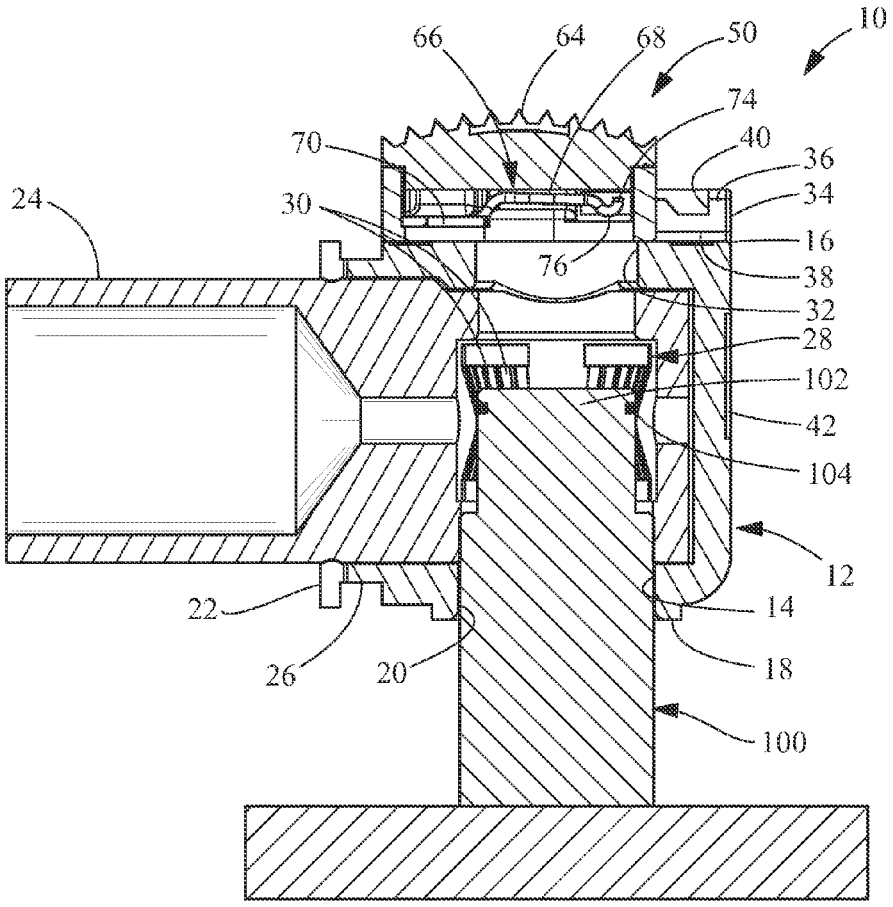
FIG. 6 is a cross-sectional view of the quick connect power connector in alignment with a mating post, illustrating the quick connect power connector prior to the mating post engaging the locking slide.

A contact 28 is positioned in the post receiving passage 14. In the embodiment shown, the contact 28 is a band which extends around the circumference of the passage 14. The band has resilient contact arms 30 which extend into the passage 14 (as best shown in FIG. 6). As the post 100 is inserted into the passage 14, the contact arms 30 are resilient deformed and are placed in electrical contact with the post 100. The contact 28 is positioned in the passage 14 such that the contact 28 will be placed in electrical engagement/contact with the post 100 regardless of the orientation of the contact 28 with respect to the post 100. This allows the wire receiving member 24 to be oriented at any position about the circumference of the post 100. The contact 28 and method of connecting the contact 28 to the post 100 are known in the industry. The conductor and wire provided in the wire receiving passage 26 is electrically connected to the contact 28 using known methods of termination. While the contact 28 is shown in the form of a band, other types of contacts can be used without departing from the scope of the invention.

A terminal post receiving opening 32 extends through the first or top end 16 of the body 12 of the connector 10. The opening 32 is positioned in alignment with post receiving passage 14. The opening 32 is dimensioned to receive a free or top end 102 of the post 100 therein.

Figure 3:
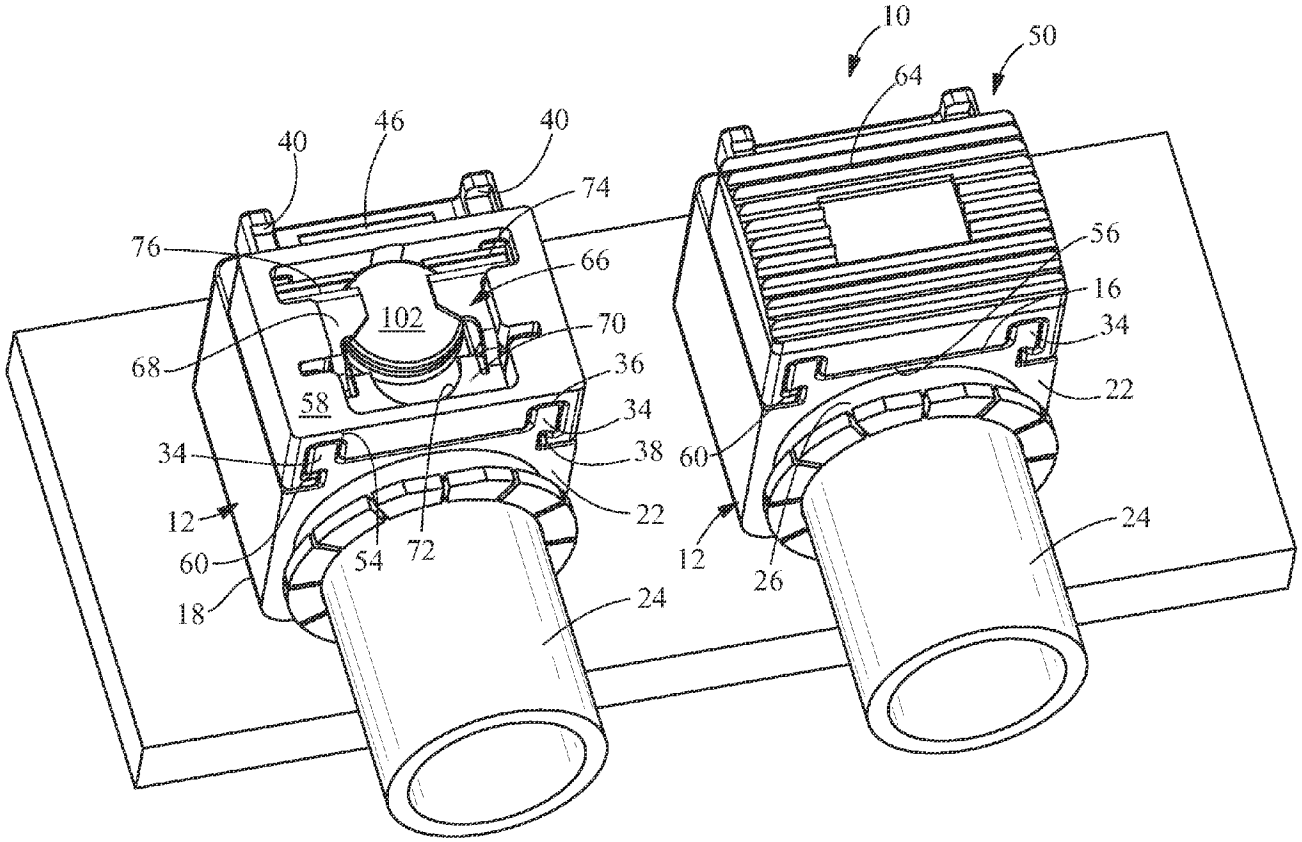
FIG. 3 is a perspective view of the quick connect power connectors of FIG. 1 positioned on the mating post, illustrating a locking slides of the quick connect power connectors in an open position, one of the quick connect power connectors has a cover of the locking slide removed for ease of understanding.
Figure 4:
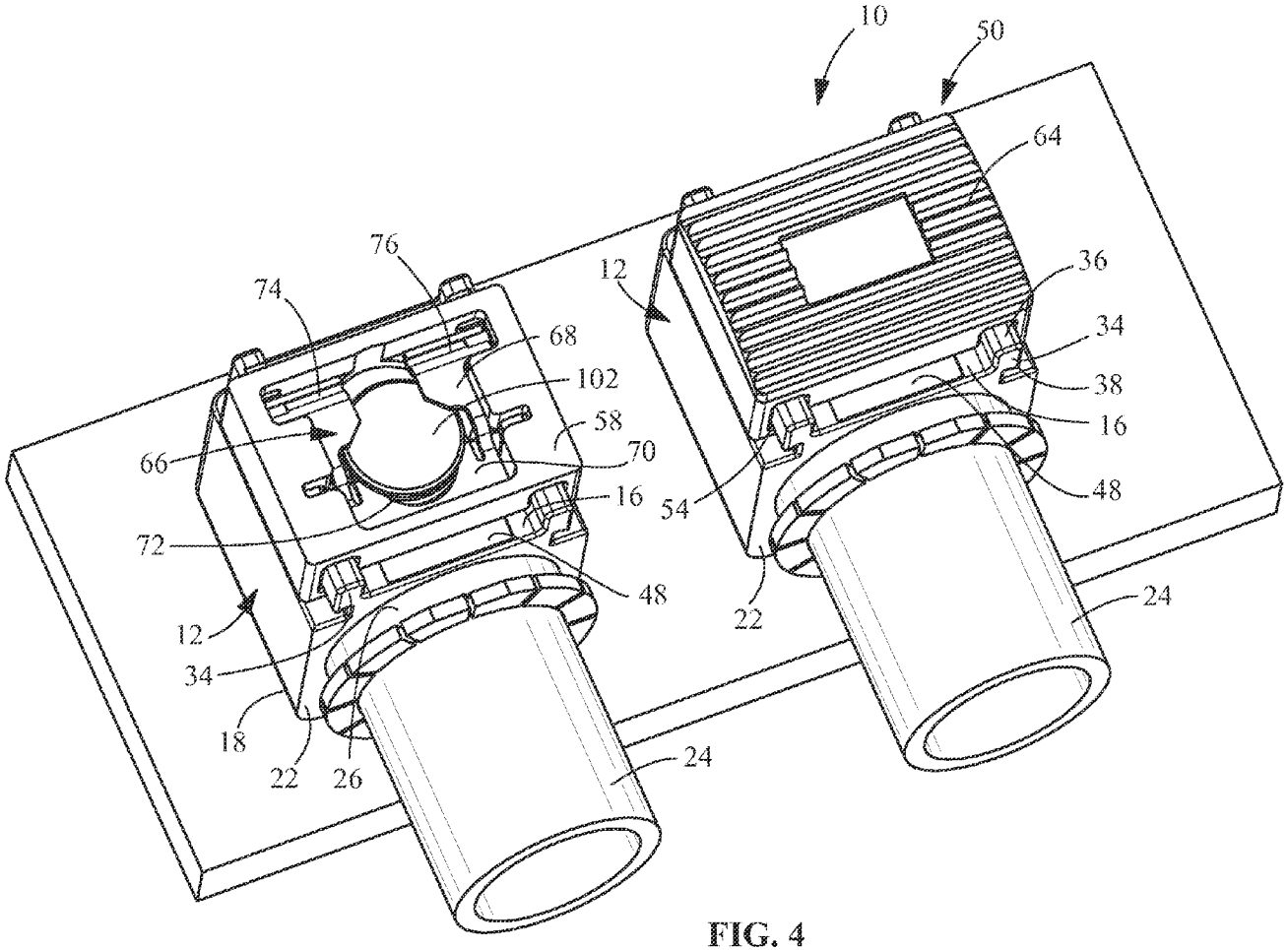
FIG. 4 is a perspective view of the quick connect power connectors, similar to that of FIG. 3, illustrating the locking slides of the quick connect power connectors in a transition position between an open position and a locked position, one of the quick connect power connectors has the cover of the locking slide removed for ease of understanding.
Figure 5:
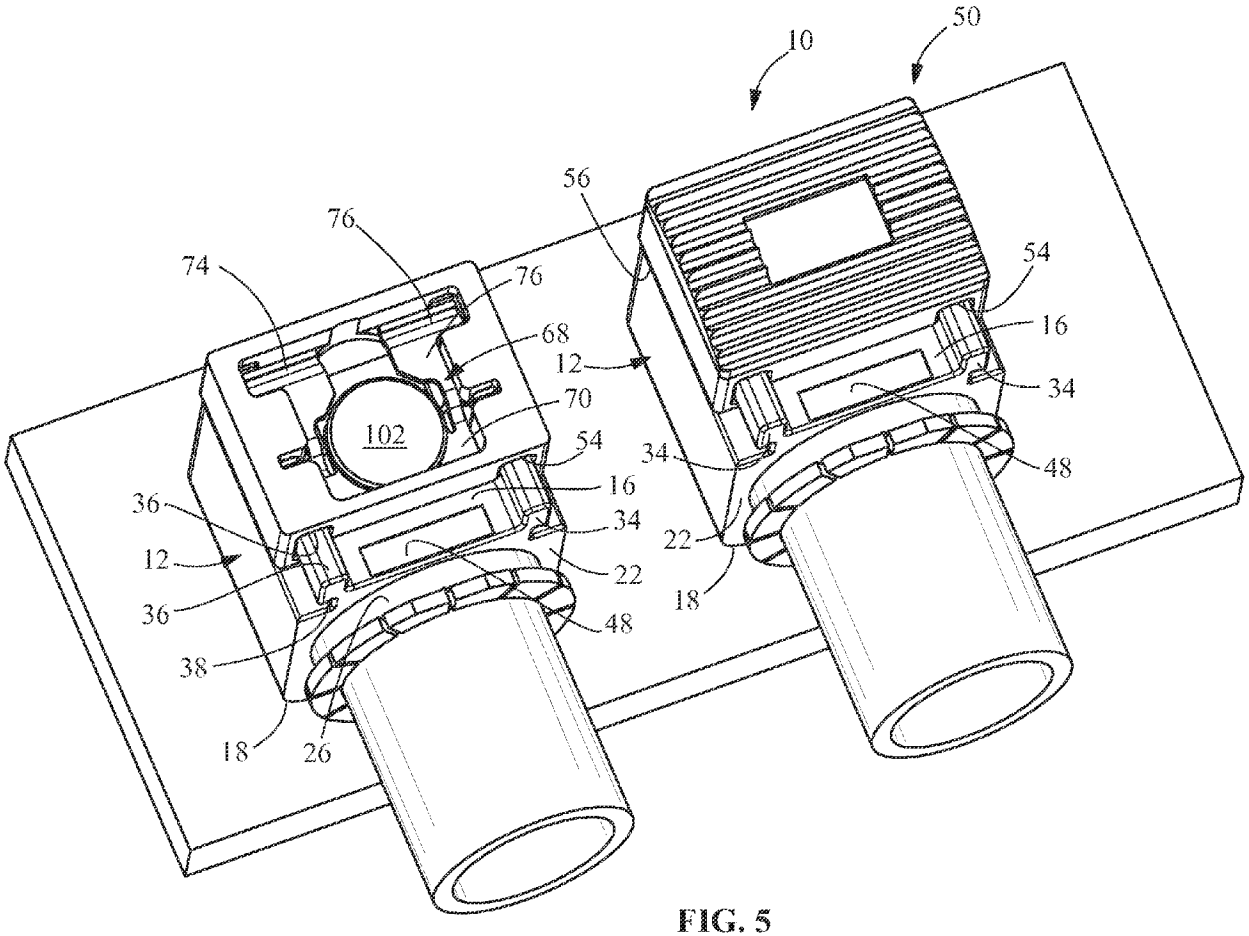
FIG. 5 is a perspective view of the quick connect power connectors similar to that of FIG. 3, illustrating the locking slides of the quick connect power connectors in fully locked position, one of the quick connect power connectors has the cover of the locking slide removed for ease of understanding.
Figure 10:
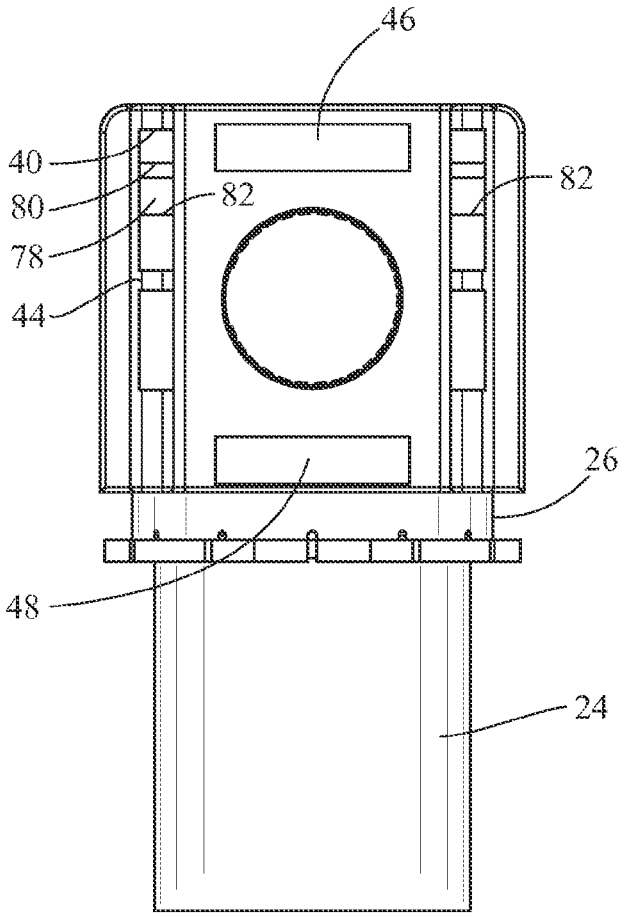
FIG. 10 is a top view of a housing of the quick connect power connector with the locking slide removed.

Projections or tracks 34 (as best shown in FIG. 10) extend from the end 16 is a direction away from end 18. The tracks 34 are provided on either side of opening 32 and, in the embodiment shown, extend essentially the entire width of the connector 10. Each track 34 has a top surface 36 and an oppositely facing bottom surface 38 (as best shown in FIGS. 3 through 5). Each track 34 includes a stop surface or projection 40 positioned proximate a sidewall 42 of the connector 10 which is essentially opposed to the sidewall 22. A slot 44 is provided in each track 34 and is spaced from the stop surface 40 at a position between the sidewall 22 and the sidewall 42.

A first reference member or visual indicator 46 is provided on the top end 16 of the connector 10. The first visual indicator 46 is provided proximate sidewall 42. In the embodiment shown, the first visual indicator 46 is a red colored box; however other types of indicators (e.g. textured or raised areas) and other colors can used without departing from the scope of the invention. A second reference member or visual indicator 48 is provided on the top end 16 of the connector 10. The second visual indicator 48 is provided proximate sidewall 22. In the embodiment shown, the second visual indicator 48 is a green colored box; however other types of indicators (e.g. textured or raised areas) and other colors can used without departing from the scope of the invention.

A locking slide 50 is slidably mounted to the end 18 of connector body 12. The locking slide 50 has an opening 52 which receives the top end 102 of the post 100 therein. The opening 52 is dimensioned to be larger than the top end 102 of the post 100 to allow the locking slide 50 to move relative to the top end 102 of the post 100, as will be more fully described.

Figure 11:
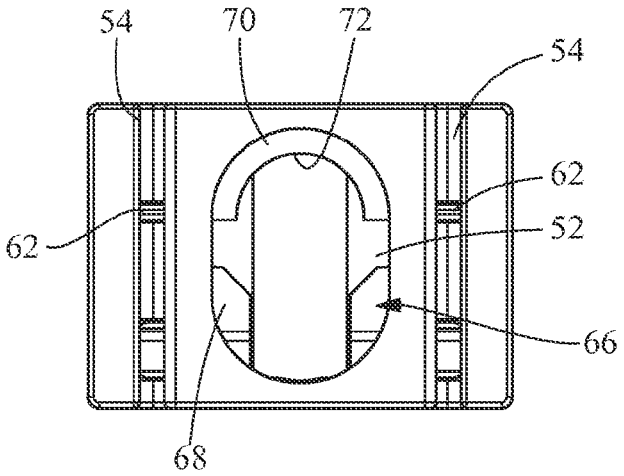
FIG. 11 is a bottom view of the locking slide prior to be positioned on the housing of the quick connect power connector.

Track receiving recesses 54 (as best shown in FIG. 11) extend from a bottom surface 56 of locking slide 50 toward a top surface 58. The track receiving recesses 54 are provided on either side of opening 52 and, in the embodiment shown, extend essentially the entire width of the locking slide 50. Each track receiving recesses 54 has a projection 60 which is dimensioned to cooperate with the bottom surface 38 of the track 34, as best shown in FIGS. 3 through 5. Each recess 54 include a hold projection 62 which extends therein. The projections 62 are provided in the recesses at a position between the sidewall 22 and the sidewall 42.

A gripping surface 64 is provided on the top surface 50. In the embodiment shown, the gripping surface 64 is a series of projections and recesses. However, any type of surface which facilitates and operator moving the locking slide 50 between an open position and a closed position can be used without departing from the scope of the invention.

Figure 12:
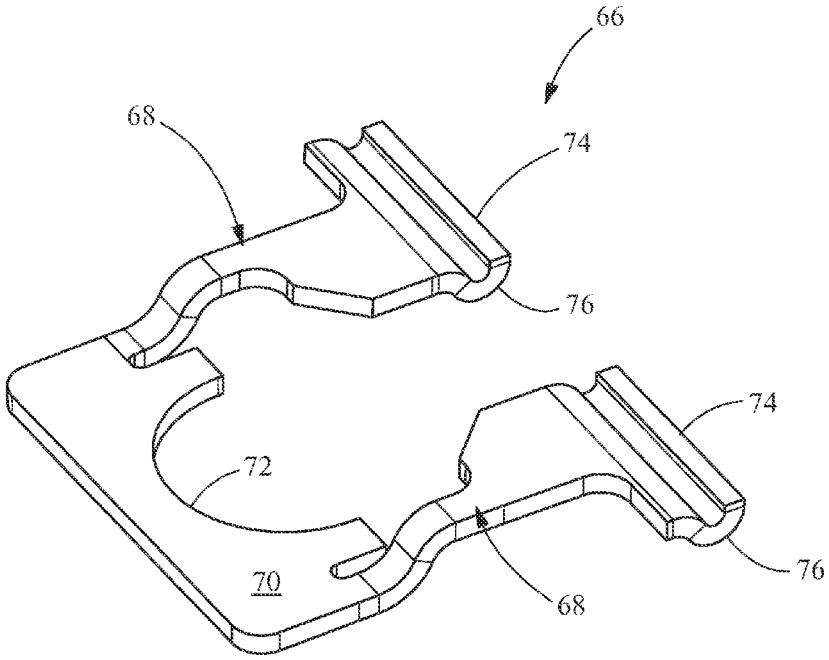
FIG. 12 is a perspective view of a locking clip which is housed in the locking slide.
Figure 13:
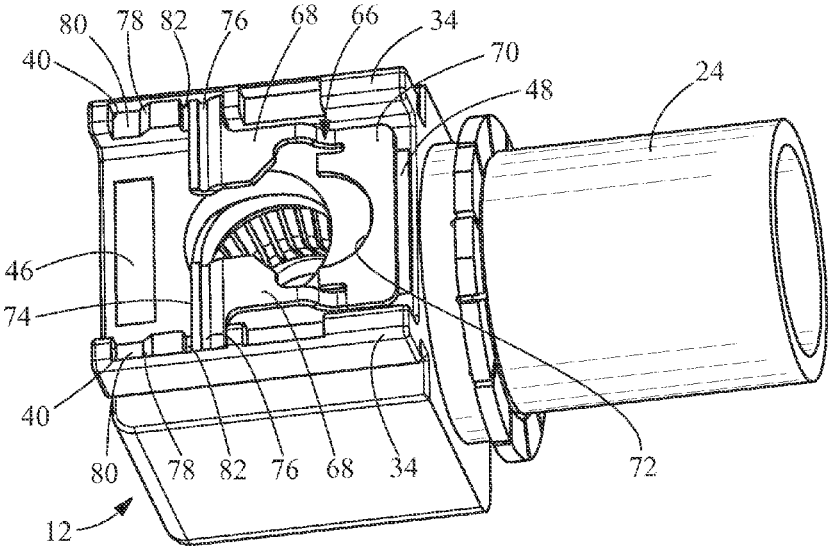
FIG. 13 is a perspective view of the connector with a portion of the locking slide removed to better shown the locking latch of the locking slide and the tracks of the connector body.

A locking latch 66 is housed in the locking slide 50. The locking slide may be overmolded over the locking latch. Alternatively, the locking latch 66 may be retained in the locking slide 50 by known securing techniques. The locking latch 66 is securely maintained in the locking slide 50, whereby the locking latch 66 moves together with the locking slide 50. As best shown in FIG. 12, the locking latch 66 has a pair of resilient latching arms 68 which extend from a locking section 70. The locking section 70 has a radiused locking surface 72 which cooperates with the post 100, as will be more fully described.

The resilient latching arms 68 extend from the locking section 70 and are mounted in the locking slide 50 to allow the resilient latching arms 68 to be resiliently deformed toward the top surface 58 of the locking slide 50. The resilient latching arms 68 are spaced from each other to allow the top end 102 of post 100 to be inserted therebetween. Proximate free ends 74 of the resilient latching arms 68 are radiused sections 76. The radiused sections 76 are configured to allow the radiused sections 76 to engage portions of the tracks 34 without damaging the tracks 34. Other configurations of the radiused sections 76 may be used without departing from the scope of the invention.

When the electrical connector 10 is mated with the mating post 100, the post 100 is received within the post receiving passage 14 of the electrical connector 10, as best shown if FIGS. 6 through 9.

FIG. 6 shows a cross-sectional view of the electrical connector 10 as the electrical connector 10 is being mated with the post 100. This view illustrates the post 100 positioned in the post receiving passage 14 prior to engaging the locking slide 50. The locking slide 50 is shown in the open or prelocked position. In this position, the locking latch 66 is in a normal or undeflected position. In this position, the locking slide 50 is positioned proximate sidewall 22. As locking slide 50 is positioned proximate sidewall 22, the locking slide 50 covers second visual indicator 48 and exposes first visual indicator 46. This provides the operator with a visual indication that the locking slide 50 is in the open or prelocked position. In this open or prelocked position, projections 62 of the track receiving recesses 54 are positioned in the slots 44 of the tracks 34. The cooperation of the projections 62 with the slots 44 secures the locking slide 50 in the open or prelocked position, thereby preventing the locking slide 50 from being inadvertently moved to closed or locked position.

Figure 7:
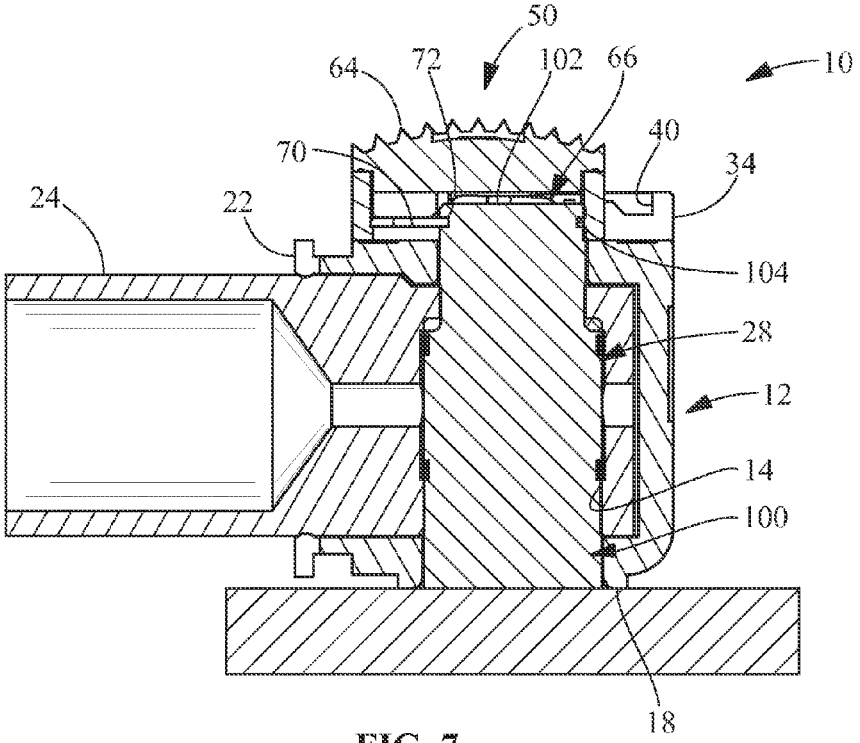
FIG. 7 is a cross-sectional view of the quick connect power connector of FIG. 3, illustrating the quick connect power connector in the open position.

As insertion of the post 100 into the post receiving passage 14 continues, the top end 102 of post 100 moves through opening 32 and between latching arms 68, as best shown in FIG. 7. As this occurs, the top surface 102 of the post 100 engages the top wall 58 of the locking slide 50. The engagement of the top surface 102 with the top wall 58 causes the locking slide 50 to move away from the top end 16 of the body 12. This movement is controlled and limited by the cooperation of the engagement of the projections 60 of the track receiving recesses 54 of the locking slide 50 with the bottom surfaces 38 of the tracks 34 of the body 12 of the connector 10. This limited movement of the locking slide 50 relative to the tracks 34 allows the projections 62 of the recesses 54 to be moved from the slots 44 of the tracks 34.

Figure 8:
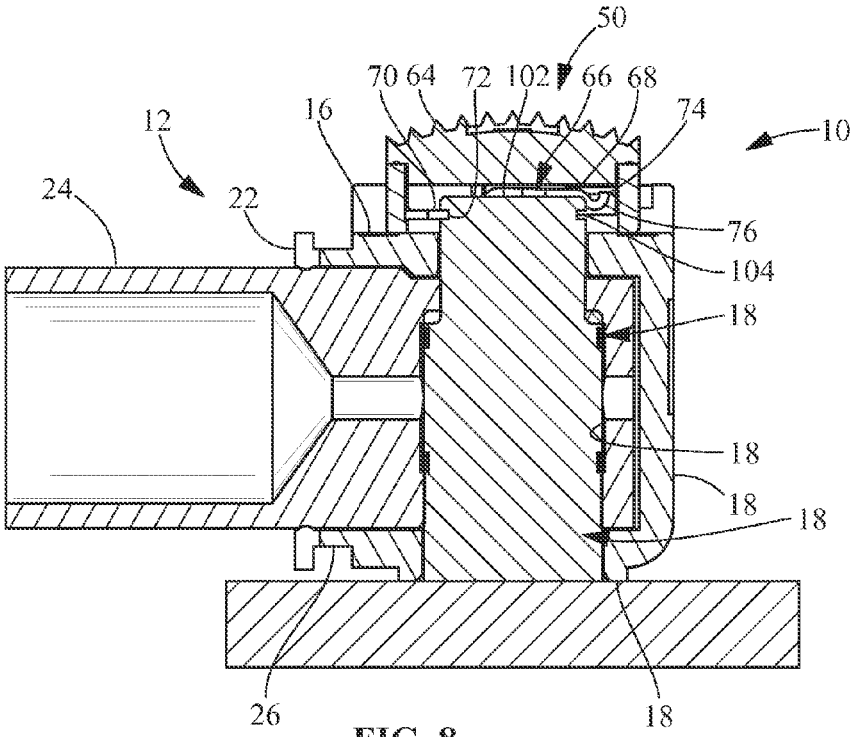
FIG. 8 is a cross-sectional view of the quick connect power connector of FIG. 4, illustrating the quick connect power connector in the transition position.
Figure 9:
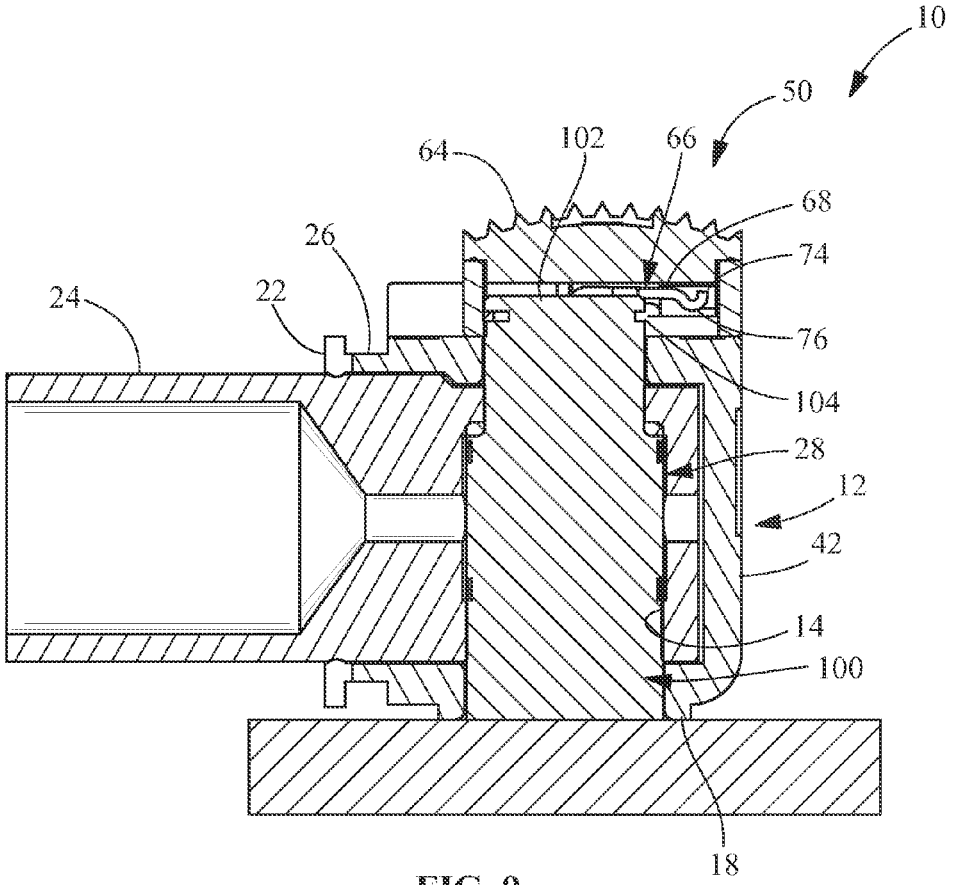
FIG. 9 is a cross-sectional view of the quick connect power connector of FIG. 5, illustrating the quick connect power connector in the closed or locked position.

With the projections 62 moved from the slots 44, the locking slide 50 can be moved from the prelocked or open position (FIGS. 3 and 7) to the transition position (FIGS. 4 and 8) and then to the closed or locked position (FIGS. 5 and 9). However, if the connector 10 is not properly mated with the post 100, the locking slide 50 will not be allowed be moved to the closed or locked position, as will be described.

As the locking slide 50 is moved from the prelocked or open position of FIG. 7 to the transition position of FIG. 8, the locking surface 72 of the locking section 70 of the locking latch 66 is moved toward the post 100. As movement of the locking slide 50 continues, the locking surface 72 is positioned in a locking surface receiving recess 104 of post 100. In the embodiment shown, the recess 104 extends circumferentially about the surface of the post 100 proximate end 102. As the recess 104 extends about the entire circumference of the post 100, the locking surface 72 can engage the recess 104 of the post 100 regardless of the orientation of the connector 10 with respect to the post 100. This allows the wire receiving member 24 to be oriented at any position about the circumference of the post 100. With the post 100 properly inserted into the connector 10, the locking surface 72 is moved into the recess 104 which allows the locking latch 66 and the locking slide 50 to be moved to the fully locked position, as shown in FIG. 9. However, if the post 100 is not fully inserted, the locking surface 72 will not be aligned with the recess 104. Additionally, the top end 102 of post 100 will not cause the resilient latching arms 66 to be moved toward the top surface 58 of the locking slide 50. In this position, the free ends 74 of the latch arms 66 abut or engage stop surfaces or walls 82 of tracks 34. Consequently, the locking slide 50 cannot be placed in the closed or locked position as the free ends 74 of the latch arms 66 will engage walls 82 to prevent the continued movement of the locking latch 66 and locking slide 50 toward the locked position. This prevents the connector 10 from being improperly inserted onto the post 100.

With the post 100 properly inserted, the top end 102 of post 100 engages the resilient latching arms 66. The causes the resilient latching arms 66 and the free ends 74 to be moved toward the top surface 58 of the locking slide 50, allowing the free ends 74 to move above walls 82. This allows the continued movement of the locking slide 50 toward the closed or locked position (FIG. 9) to continue, allowing the locking surface 72 to be moved into the recess 104. As insertion continues, the resilient latching arms 68 are moved beyond the inclined surfaces 78 and into recesses 80 which allow the latching arms 68 to return toward an unstressed position. Further movement of the locking slide 50 toward the sidewall 42 is prevented, as the radiused sections 76 engage the stop projections 40 of the tracks 34 to prevent further unwanted movement of the locking slide 50.

The positioning of the radiused sections 76 in the recesses 80 also prevents the unwanted movement of the locking slide 50 and locking latch 66 back toward the open position. Consequently, as the locking slide 50 and locking latch 66 are retained in the closed or locked position, environmental conditions, such as, but not limited to, vibration, do not result in the inadvertent or unwanted electrical disengagement of the connector 10 from the post 100. This ensures that a positive electrical connection will be maintained.

When the locking slide 50 is in the open position, the locking slide 50 is position proximate sidewall 22. In this position the second visual indicator 48 is covered and the first visual indicator 46 is exposed, providing the operator a visual indication that the locking slide 50 is in the open or prelocked position. When the locking slide 50 is in the closed or locked position, the locking slide 50 is position proximate sidewall 42. In this position the second visual indicator 48 is exposed and the first visual indicator 46 is covered, providing the operator a visual indication that the locking slide 50 is in the closed or locked position. When the locking slide 50 is in the transition position, the locking slide 50 is position between sidewall 42 and sidewall 22. In this position neither the second visual indicator 48 nor the first visual indicator 46 is fully exposed, providing the operator a visual indication that the locking slide 50 is not properly positioned in the closed or locked position. This allows the operator to visually determine if the connectors 10 are fully mated or only partially mated to the posts 100.

The use of the visual indicators are easily detectable by either the human eye, a bar code type reader, a UV scanner or other device, thereby allowing for a positive indication to assure that the connector 10 is fully mated to mating post 100. For example, if ink of a contrasting color, laser marking and/or a UV tracer are used for the visual indicators, a hand held scanner can be used to determine if the connectors 10, 100 are fully mated even in blind mate areas.

The connector 10, system and method described herein provides a simple and reliable connector to mating posts and to the power bus to which the posts are connected. The connector is inserted onto the post making an electrical connection thereon. The use of the locking slide ensures that the connector is fully inserted onto the post, thereby ensuring that a positive electrical connection is provided and maintained. The visual indication provides a quick and cost effective means to confirm that the connection is secured.

The connector 10 and locking slide 50 are provided as one piece. There are no loose components which can fall during installation or which can come loose during operation. Therefore, potential damage to the equipment in which the connectors 10 are installed and used from foreign object debris (FOB) is greatly reduced. In addition, as the connectors required no tooling to install, the installation of the connectors 10 is greatly simplified.

The one piece connector according to the present invention performs all of the functions of the prior art multi component connectors. The one piece design results in a significant cost advantage over the prior art connectors.

The configuration of the connector 10, the contact 28 and the locking latch 66 allow for the connector to be inserted onto the post 100 from any direction. In any circumstances, it is difficult to manipulate and twist the wire connected to the contact 28 through the wire receiving member 24. Often because of lack of space or the inflexibility of the wire, it is important that the connector 10 be able to be terminated to the post regardless of the orientation of the wire relative to the post. As the contact 28 and locking latch 66 are operable no matter the orientation relative to the post, the present invention allows the termination of the wire to the post without damage to the wire or the post.

The use of the locking slide 50 and locking latch 66 allows the connector 10 to remain in electrical engagement with the post 100 regardless of the environmental conditions to which the connector and system are exposed. For example, vibration applied to either the post or the connector will not cause the failure of the electrical connection therebetween.

While the quick connect and disconnect connector can be used for many application, the configuration allows for use with high amperage electrical connections which require up to 1000 amps per contact.

The body 12 of the connector 10 and the locking slide are made from plastic or other material having nonconductive properties. Consequently, the connector 10 may be engaged by the operator/user.

While the invention has been described with reference to a preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector for connecting to a terminal post, the electrical connector comprising:

a nonconductive housing body having a post receiving passage for receiving the terminal post therein;

a contact provided in the post receiving passage, the contact is provided in electrical engagement with the terminal post inserted into the post receiving passage regardless of the orientation of the contact with respect to the terminal post; and a locking slide moveably mounted to the housing body, the locking slide being moveable between a prelocked position and a locked position, the locking slide having a locking latch, the locking latch having a locking surface which cooperates with a recess of the terminal post when the locking slide is in the locked position.

2. The electrical connector as recited in claim 1, wherein the housing body has a wire receiving passage which extends from a sidewall to the post receiving passage.

3. The electrical connector as recited in claim 1, wherein the contact is a band which extends about the circumference of the post receiving passage.

4. The electrical connector as recited in claim 3, wherein the band has resilient contact arms which extend into the post receiving passage.

5. The electrical connector as recited in claim 1, wherein a terminal post receiving opening extends through a first end of the connector body, the terminal post receiving opening is in alignment with the post receiving passage, the opening dimensioned to receive a free end of the terminal post therein.

6. The electrical connector as recited in claim 5, wherein projections extend from the first end of the body, the projections are provided on either side of terminal post receiving opening.

7. The electrical connector as recited in claim 6, wherein each projection has a top surface and an oppositely facing bottom surface, each projection includes a stop surface positioned proximate a respective sidewall of the body of the connector.

8. The electrical connector as recited in claim 7, wherein a slot is provided in each projection at a position spaced from the stop surface.

9. The electrical connector as recited in claim 1, wherein a first reference member is provided on a first end of the body of the connector, the first reference member is provided proximate a first sidewall of the body of the connector, a second reference member is provided on a first end of the body of the connector, the second reference member is provided proximate a second sidewall of the body of the connector, wherein when the locking slide is in the prelocked position, the first reference member is visible and when the locking slide is in the locked position, the second reference member is visible.

10. The electrical connector as recited in claim 1, wherein the locking latch is securely maintained in the locking slide, wherein the locking latch moves together with the locking slide.

11. The electrical connector as recited in claim 10, wherein the locking latch has a pair of resilient latching arms which extend from a locking section, the locking surface is provided on the locking section, the locking surface is radiused to cooperate with the recess of the post.

12. The electrical connector as recited in claim 11, wherein the resilient latching arms are mounted in the locking slide to allow the resilient latching arms to be resiliently deformed toward a top surface of the locking slide, the resilient latching arms are spaced from each other to allow the terminal post to be inserted therebetween.

13. The electrical connector as recited in claim 1, wherein radiused sections are provided proximate free ends of the resilient latching arms, the radiused sections are configured to allow the radiused sections to engage portions of the projections, wherein the radiused sections cooperate with recesses in the projections to prevent the unwanted movement of the locking slide and locking latch from the locked position.

14. An electrical connector for connecting to a terminal post, the electrical connector comprising:

a nonconductive housing body having a post receiving passage for receiving the terminal post therein, the housing body having a stop surface provided thereon;

a contact provided in the post receiving passage, the contact is provided in electrical engagement with the terminal post inserted into the post receiving passage regardless of the orientation of the contact with respect to the terminal post;

a locking slide moveably mounted to the housing body, the locking slide being moveable between a prelocked position and a locked position; and a locking latch securely maintained in the locking slide, the locking latch cooperating with the stop surface to prevent the movement of the locking slide to the locked position if the electrical connector is not properly mated to the terminal post, the locking latch having a radiused locking surface which cooperates with a recess of the terminal post when the locking slide is in the locked position.

15. The electrical connector as recited in claim 14, wherein a first reference member is provided on a first end of the body of the connector, the first reference member is provided proximate a first sidewall of the body of the connector, a second reference member is provided on a first end of the body of the connector, the second reference member is provided proximate a second sidewall of the body of the connector, wherein when the locking slide is in the prelocked position, the first reference member is visible and when the locking slide is in the locked position, the second reference member is visible.

16. An electrical connector for connecting to a terminal post, the electrical connector comprising:

a nonconductive housing body having a post receiving passage for receiving the terminal post therein;

a contact provided in the post receiving passage, the contact is provided in electrical engagement with the terminal post inserted into the post receiving passage regardless of the orientation of the contact with respect to the terminal post;

a locking slide moveably mounted to the housing body, a first reference member provided on a first end of the body of the connector, the first reference member provided proximate a first sidewall of the body of the connector;

a second reference member provided on the first end of the body of the connector, the second reference member provided proximate a second sidewall of the body of the connector;

wherein when the locking slide is in the prelocked position, the first reference member is visible and when the locking slide is in the locked position, the second reference member is visible.

17. The electrical connector as recited in claim 16, further comprising:

projections extends from the housing body on either side of the post receiving passage;

recesses which cooperate provided in the locking slide, the recesses cooperate with the projections allowing the locking slide to be moved between a prelocked position and a locked position.

18. The electrical connector as recited in claim 17, wherein the locking slide has a locking latch, the locking latch has a locking surface which cooperates with a recess of the terminal post when the locking slide is in the locked position.

19. The electrical connector as recited in claim 18, wherein the locking latch is securely maintained in the locking slide, the locking latch having a radiused locking surface which cooperates with a recess of the terminal post when the locking slide is in the locked position, wherein the electrical connector can be mounted to the terminal post from any direction.

20. The electrical connector as recited in claim 19, wherein the contact extends about the circumference of the post receiving passage, the contact has resilient contact arms which extend into the post receiving passage.

* * * * *